United States Patent [19]

Berry et al.

[11] Patent Number: 4,880,315

[45] Date of Patent: Nov. 14, 1989

[54] ROLL-UP CARRYING BAG WITH ADJUSTABLE COMPARTMENTS

[76] Inventors: Marilee G. Berry; Dickey J. Berry, both of 5787 Via Barcelona, La Verne, Calif. 91750

[21] Appl. No.: 270,642

[22] Filed: Nov. 14, 1988

[51] Int. Cl.[4] ..... A45C 13/02; B65D 30/22

[52] U.S. Cl. ..... 383/39; 150/113

[58] Field of Search ..... 150/112, 113; 383/39; 190/109, 110

[56] References Cited

U.S. PATENT DOCUMENTS

| | | | |
|---|---|---|---|
| 607,130 | 7/1898 | Rapp . | |
| 1,134,561 | 4/1915 | Smith | 190/109 |
| 1,430,333 | 9/1922 | Smith | 190/109 |
| 1,513,514 | 10/1924 | London | 383/39 |
| 1,526,122 | 2/1925 | Dau | 383/39 |
| 2,532,517 | 12/1950 | Schwartzman et al. | 383/39 |
| 3,181,751 | 5/1965 | Wilson . | |
| 3,749,233 | 7/1973 | McCormick . | |
| 4,715,499 | 12/1987 | Franklin . | |
| 4,738,547 | 4/1988 | Brown . | |

*Primary Examiner*—Stephen P. Garbe

*Attorney, Agent, or Firm*—Christie, Parker & Hale

[57] ABSTRACT

A configurable carrying bag includes a main panel of flexible material and at least one elongated pocket-forming panel of flexible material, overlying and extending across a portion of the main panel. The pocket-forming panel is permanently affixed to the main panel to form an elongated main pocket extending between the overlying panels and extending across the width of the carrying bag, with an elongated opening to the interior of the main pocket extending laterally across the carrying bag. A row of pin eyes closely spaced apart, are affixed adjacent to and are mutually spaced apart along the opening to the main pocket. A plurality of spring clips are each adapted for releasable attachment to the pin eyes, and each clip is selectably movable from a corresponding pin eye between an in-use position and an unused position. In the in-use position, each spring clip is inserted into a selected pin eye to releasably secure the pocket-forming panel to the main panel to form separate, reconfigurable dividers at intervals along the main pocket for configuring the main pocket into smaller pockets of selected width. This provides a way to reconfigure the width of the smaller pockets for matching articles of various sizes. The carrying bag can include a main panel having a flap portion extending away from the pockets for securing the closed carrying bag in a roll-up configuration.

7 Claims, 3 Drawing Sheets

ROLL-UP CARRYING BAG WITH ADJUSTABLE COMPARTMENTS

FIELD OF THE INVENTION

This invention relates to carrying bags, and more particularly to a carrying bag which can be configured to form adjustable-sized pockets for custom fitting articles to be stored in the carrying bag.

BACKGROUND OF THE INVENTION

It is common for women to carry a variety of items in a large handbag or purse. These items can include cosmetics such as lipstick, nail polish, perfume, makeup, and the like; scissors; nail clippers and nail files; hair clips; sewing items; safety pins; medication and first-aid items; etc.

These items are often carried loosely in the purse and usually settle to the bottom of the purse, creating a cluttered, disorganized array of objects at the bottom of the purse. Specific items are then difficult to find, and the disarray of items at the bottom often takes up so much space that they do not leave room in the purse for other important items such as a wallet, for example.

The present invention provides a solution to these problems by providing a configurable carrying bag in which pockets of adjustable size can be formed at will by the user. As a result, a large number of articles normally carried loosely in a purse can be carried in an organized manner in individual pockets which are configurable to adapt to the size of each article. The carrying bag is closed in a narrow profile configuration with the individual articles being securely held in place while occupying very little space.

SUMMARY OF THE INVENTION

Briefly, one embodiment of this invention provides a configurable carrying bag comprising a main panel formed by a flexible material, and at least one elongated pocket-forming panel made from a flexible material, overlying and extending across a portion of the main panel. The pocket-forming panel is permanently affixed to the main panel so it forms an elongated main pocket between the overlying panels, with an elongated opening to the interior of the main pocket extending across a top edge of the pocket-forming panel. A row of fastening means are affixed adjacent to and are mutually spaced apart along the opening to the main pocket. A plurality of pin means are each adapted for releasable attachment to the individual fastening means, and each pin is selectively movable from its fastened position between an unused position and an in-use position. When the pins are in use, they releasably secure the pocket-forming panel to the main panel to thereby form separate reconfigurable dividers at intervals along the main pocket for configuring the main pocket into smaller individual pockets of selected width. The pins are each movable from the in-use position to the unused position to enable constantly reconfiguring the arrangement of smaller pockets at will. The main panel also may have a flap portion extending away from the pocket-forming panel to provide a closure for the articles contained in the reconfigurable pockets.

In one embodiment of the invention, the pins comprise separate spring clips which, in use, are bendable to apply spring pressure to the overlying pocket-forming panel to form the individual smaller panels. The fastening means can comprise pin eyes spaced apart at intervals along the opening to the main pocket. The spring clips can be releasably positioned by inserting them into selected pin eyes so the clips form the individual smaller pockets by spring pressure that divides the main pocket into the separate smaller pockets.

Thus, the individual pockets can be configured by the user to custom-fit each item to be stored in the carrying bag. This customization can be done by the spring clips or other pins which are set into the back of the main pocket at narrow intervals; and when the user is ready to form the individual pockets, the pins are simply moved to a position in which they are pressed over the main pocket to hold it to the back of the main panel firmly, creating the smaller individual pockets. Each time a pin is pressed into its in-use position, multiple pockets are created. The articles are also held securely in the pockets by the top flap, which can be an extension of the main panel. This flap is fastened by releasable fasteners which can form a rollup carrying bag, if desired.

Uses of the invention include, but are not limited to, carrying cosmetic and other items for women's handbags, tool grips for small hand tools, and the like.

These and other aspects of the invention will be more fully understood by referring to the following detailed description and the accompanying drawings.

DRAWINGS

DETAILED DESCRIPTION

Figure 1:
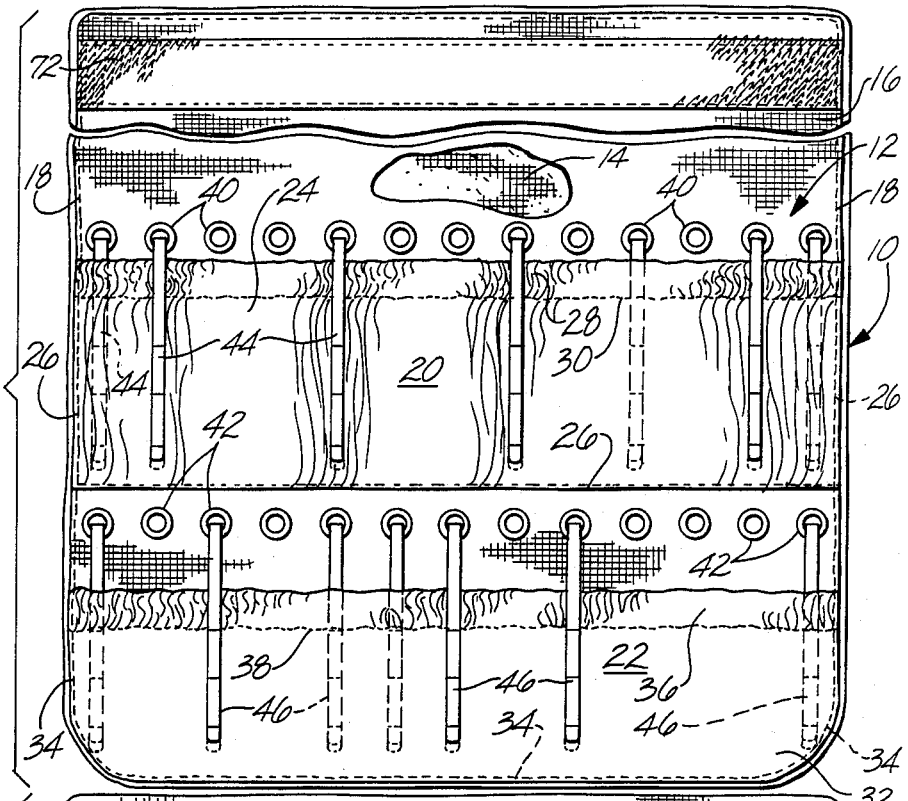
FIG. 1 is a fragmentary, semi-schematic elevation view, partly broken away, illustrating a front side of a configurable carrying bag according principles of this invention.
Figure 2:
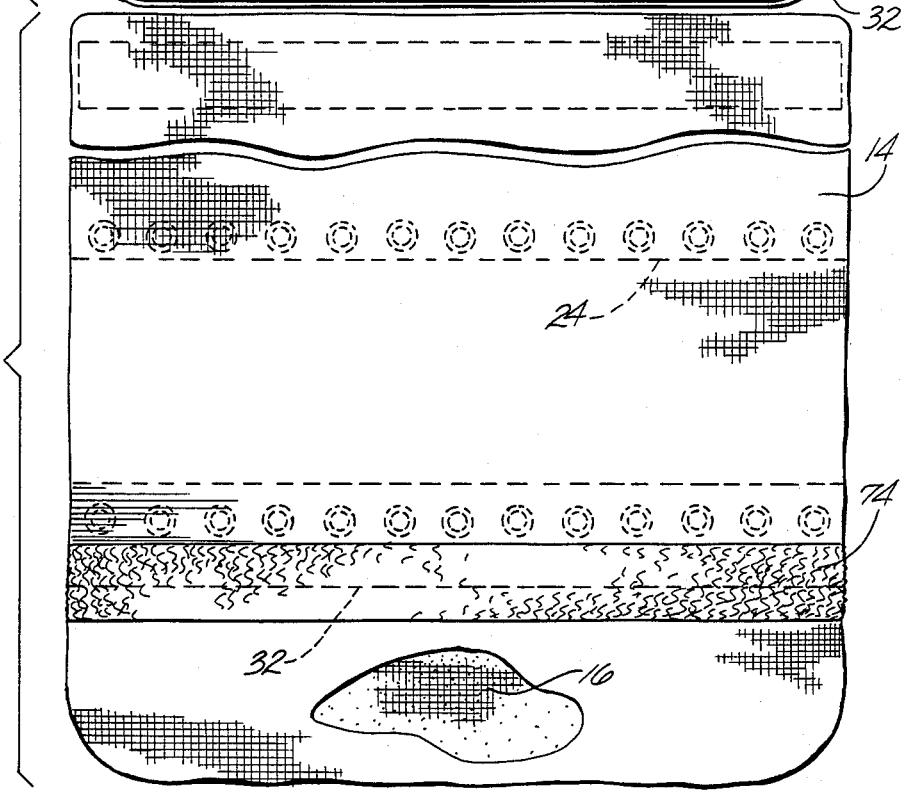
FIG. 2 is a fragmentary, semi-schematic elevation view, partly broken away, showing the reverse side of the carrying bag shown in FIG. 1.

FIGS. 1 and 2 illustrate opposite sides of a configurable carrying bag 10 according to principles of this invention. The bag includes a main panel 12 made from a flexible and foldable material. The main panel preferably includes an elongated flat outer face sheet 14 of fabric such as cotton. A liner 16 of reinforcing fabric such as silk, rayon, nylon, taffeta, etc. is fastened to the outer face sheet 14 by peripheral stitching 18.

A pair of longitudinally spaced apart and parallel upper and lower main pockets 20 and 22 extend laterally across a bottom portion of the main panel. The upper and lower pockets collectively traverse about one-third of the area of the panel and are preferably on the lower portion of the panel.

The upper main pocket 20 is formed by an elongated flexible and foldable upper panel 24 of fabric such as silk, rayon, nylon, taffeta, etc. The upper panel is generally long and rectangular in shape and is secured to the main panel 12 on three sides by peripheral stitching 26.

The upper panel is also gathered, and an upper elastic band 28 is fastened along its top to form a long, narrow elasticized upper pocket. The upper elastic band 28 is secured to the upper edge of the upper panel by stitching 30.

Similarly, the main lower pocket 22 is formed by an elongated flexible and foldable lower panel 32 of fabric, preferably made from the same fabric as the upper main pocket. The lower panel is generally long and rectangular in shape and is secured to the main panel 12 on three sides by peripheral stitching 34. The lower panel is gathered and elasticized by a lower elastic band 36 secured along the opening to the main lower pocket by stitching 38.

Thus, two long parallel upper and lower main pockets, with elasticized openings leading to the interior of each pocket, are formed along the bottom portion of the main panel 12. The upper and lower panels 24 and 32 form the front side of each pocket, and the main panel 12 forms the back side of each pocket.

An upper row of pin eyes 40 extends along the main panel adjacent to and preferably above the top edge of the upper panel 24. The upper pin eyes are preferably spaced apart at uniform intervals, which can be $\frac{3}{8}$ to $\frac{1}{2}$ inch on-center spacing for an 8-inch wide main panel, for example.

Similarly, a lower row of pin eyes 42 extends along the main panel adjacent to and preferably above the top edge of the lower panel 32. The lower pin eyes are preferably spaced apart at uniform intervals substantially with the same spacing as the upper row of pin eyes.

A plurality of mutually spaced apart upper spring clips 44 are releasably inserted into the pin eyes in the upper row. Similarly, a plurality of mutually spaced apart lower spring clips 46 are releasably inserted into the pin eyes in lower row. Preferably, there are fewer spring clips in each row than the number of pin eyes in each row. The spring clips are preferably long, narrow, inverted U-shaped fasteners similar to a bobby pin or metal clip in which opposite sides of the clip are held together normally by spring tension. The opposite sides of the clip can be pried apart by finger pressure and will normally spring back to the closed position with its sides held together by spring tension. The length of each spring clip is preferably about the same as the distance from each pin eye to the bottom of the main pocket located immediately below it.

The spring clips are releasably fastened to selected ones of the pin eyes in each row. The spring clips are inserted into the pin eyes by prying apart the sides of the clip and inserting the back side of the clip into a corresponding pin eye. The back side of each clip is then pushed down into the space between the outer face sheet 14 of the main panel and the reinforcing liner 16, for placing the clip in a fixed position in the pin eye. The clip, when fastened to the pin eye, can be positioned at will between an in-use position and an unused position. In the in-use position, the clip is moved so as to place the outer side of the clip over the outer face of either the upper or lower panel 24 or 32, and then the clip is pushed downwardly toward the bottom of the panel below it. The top of the clip remains releasably fastened in its corresponding pin eye, and the clip applies spring pressure to the upper or lower panel, against the main panel. By fastening a number of spring clips in the in-use position at selected intervals along either the upper or lower main pocket, each main pocket can be separated into spaced apart smaller pockets in each row using the in-use position of the spring clips as movable dividers. The spring pressure of the spring clips in their in-use position holds the upper or lower panel of the main pocket in pressure contact with the main panel below it, to provide good separation between the smaller pockets formed between the dividers. Any spring clips which are not to be used as dividers for the pockets can be left in the unused position, shown in hidden lines in FIG. 1, in which the outer side of each spring clip is left inside the front panels of the upper and lower main pockets.

Thus, the spring clips can be removed entirely from the pin eyes and selectively placed in any one of the pin eyes, and then pushed down to the in-use position to form multiple side-by-side smaller pockets along the length of the upper and lower panels 24 and 32. This provides an effective means of constantly reconfiguring the upper and lower panels into a number of side-by-side and mutually spaced apart smaller pockets which are reconfigurable into selected sizes at will. The individual pockets in each row are simply configured to match the size of each article to be held in the separate reconfigured pockets.

Figure 3:
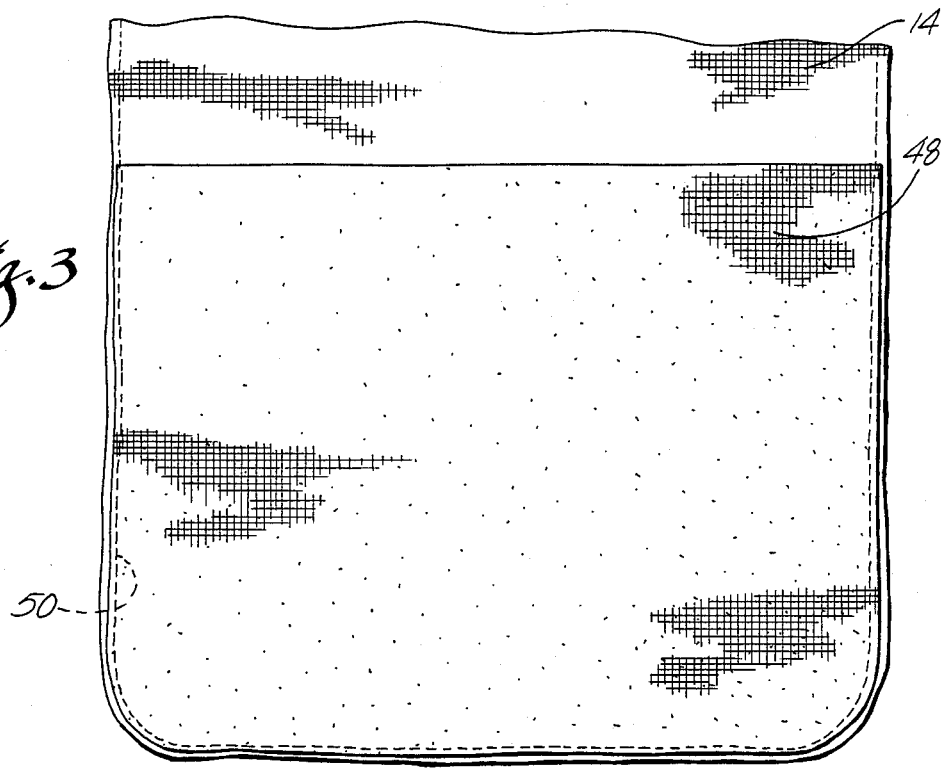
FIG. 3 is a fragmentary, semi-schematic elevation view illustrating one side of the interior construction of the carrying bag.
Figure 4:
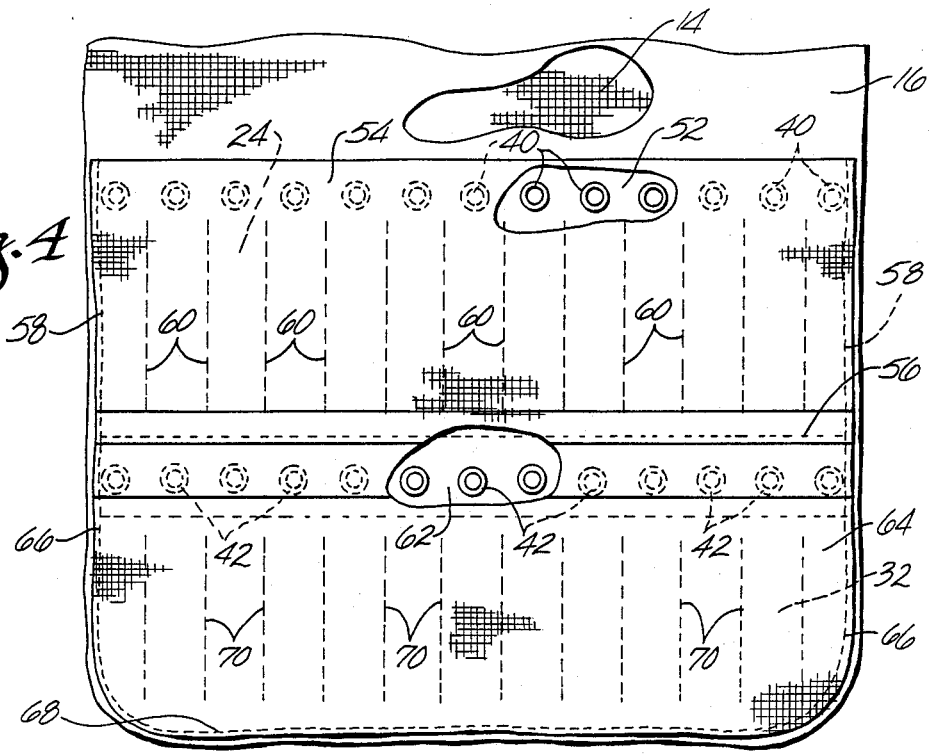
FIG. 4 is a fragmentary, semi-schematic elevation view, partly broken away, illustrating the internal construction of the carrying bag taken from a side opposite that shown in FIG. 3.

FIGS. 3 and 4 illustrate the internal construction of the configurable carrying bag. To best illustrate its internal construction, FIGS. 3 and 4 show the carrying bag turned inside out relative to the views shown in FIGS. 1 and 2. FIG. 3 illustrates an interior side of the carrying bag on the side opposite from the pockets. On this side, face of the main panel outer face sheet 14 is reinforced by a flexible and foldable reinforcing sheet 48, preferably made from a non-woven paper-like reinforcing sheet such as rayon. Of course, the reinforcing sheet 48 can be made of other flexible and foldable fabrics without departing from the scope of the invention. The reinforcing sheet 48 is preferably affixed to the inside face of the outer face sheet 14 by peripheral stitching 50.

Referring to FIG. 4, the upper and lower rows of pockets and the adjacent upper and lower rows of pin eyes are reinforced by a system of reinforcing sheets of a paper-like flexible and foldable fabric such as non-woven rayon fibers. This reinforcing system includes an upper bottom sheet 52 to provide backing for the upper pocket main panel 24. The pin eyes 40 in the upper row extend through the bottom reinforcing sheet 52 to provide a reinforcing means of attaching the pin eyes to the carrying bag. A second upper outer face sheet 54 of reinforcing material overlies the upper row of pin eyes and the upper panel 24. A bottom row of peripheral stitching 56 fastens the bottom portions of the overlying sheets 52 and 54 to the carrying bag, along with side rows of peripheral stitching 58. Separate laterally spaced apart and parallel, uniformly spaced apart rows of stitching 60 extend along the length of the upper face sheets 52 and 54 to provide separate narrow pockets below the individual pin eyes 40. These individual pockets between the rows of stitching 60 provide means for receiving the back sides of the spring clips when they are mounted in the pin eyes, so as to restrict lateral movement of the clips in either their in-use or unused positions. Therefore, by inserting the spring clips into the pin eyes and pushing them down into the narrow pockets formed below the pin eyes, the spring clips are held in a reasonably fixed position when moved into their selected positions in the pin eyes. This provides effective fixed dividers for the reconfigured smaller pockets formed by the spring clips. The pockets formed below the pin eyes also provide a means for preventing the spring clips from being tangled with one another when adjacent spring clips are held in the unused position.

Similarly, the lower main pocket is reinforced by a bottom reinforcing sheet 62 and an outer reinforcing sheet 64 overlying the bottom sheet 62. The bottom sheet 62 reinforces the lower row of pin eyes 42. The reinforcing sheets 62 and 64 are fixed to the carrying bag main panel by side rows of stitching 66. A bottom row of stitching 68 fastens the bottom portion of the bottom reinforcing sheet 62 to the carrying bag main panel. Vertically extending rows of uniformly spaced apart stitching 68 between the two overlying reinforcing sheets 62 and 64 form dividers for the separate sleeve-like pockets below the corresponding lower pin eyes 42. These narrow pockets 68 provide a means for limiting the lateral movement of the spring clips fastened to the lower row of pin eyes 42.

Figure 5:
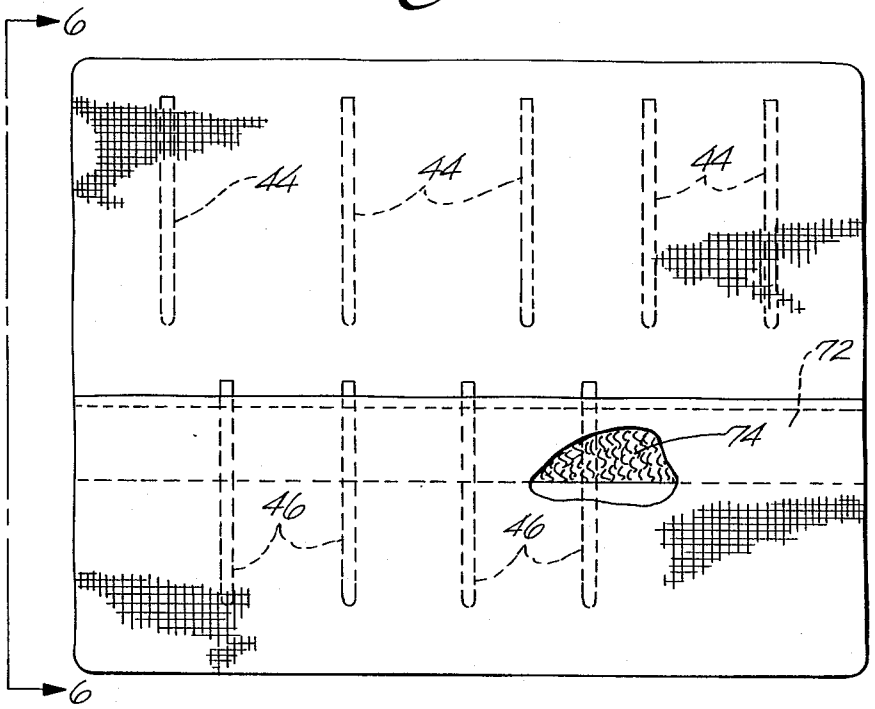
FIG. 5 is a semi-schematic elevation view showing the carrying bag in a closed position.
Figure 6:
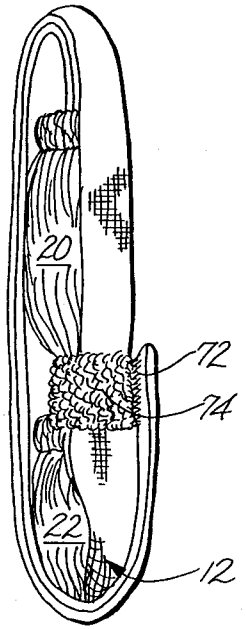
FIG. 6 is an end elevation view taken on line 6—6 of FIG. 5.

The main panel 12 has an elongated upper portion which extends away from the upper and lower pockets to form a flexible flap for enclosing the objects contained in the upper and lower rows of smaller pockets. The flap is preferably long enough to be drawn down to cover the upper and lower rows of pockets and then folded back on the opposite side of the carrying bag to form a roll-up configuration. The end of the flap has fastening means, preferably in the form of an elongated, upper fastener strip 72 such as a Velcro fastener of the hook type. A corresponding elongated Velcro fastener strip 74 is affixed to the carrying bag on a side opposite from the upper and lower rows of pockets. The Velcro fastener strips 72 and 74 can be pressed together to close the carrying bag across its entire width. FIG. 6 illustrates a side view of the roll-up carrying bag with the Velcro strips fastened together. FIG. 5 schematically illustrates the rolled up configuration of the bag in which upper rows of spring clips 44 and 46 form the upper and lower rows of smaller pockets for carrying articles of varying sizes.

What is claimed is:

1. A configurable carrying bag comprising:

a main panel formed by a flexible material;

at least one elongated pocket-forming panel made from a flexible material, overlying and extending across a portion of the main panel;

means permanently fastening the pocket-forming panel to the main panel, so as to form an elongated main pocket between the overlying panels, with an elongated opening to the interior of the main pocket extending across a top portion of the pocket-forming panel;

a row of fastening means affixed adjacent to and mutually spaced apart along the opening of the main pocket; and a plurality of pin means, each adapted for releasable attachment to the individual fastening means, and each selectably movable from its fastened condiion, between an unused position and an in-use position to releasably secure the pocket-forming panel to the main panel to thereby form separate, reconfigurable dividers at intervals along the main pocket for configuring the main pocket into smaller, individual pockets of selective width, between the dividers, the pin means each being movable from its in-use position to said unused position for use in constantly reconfiguring the arrangement of smaller pockets;

the main panel having a flexible flap portion extending away from the pocket-forming panel to provide a cover for articles contained in the reconfigurable pockets.

2. The article according to claim 1 in which the pin means comprise separate spring clips which in use apply spring pressure to the pocket-forming panel and to the main panel below it.

3. The article according to claim 2 in which the fastening means comprises pin eyes spaced apart at intervals along the length of the pocket-forming panel; and in which the spring clips are releasably fastened by inserting them into each pin eye.

4. The article according to claim 3 including separate, internally formed narrow sleeves below the pin eyes to removably receive the spring clips.

5. The article according to claim 4 in which the spring clips in the unused position are contained within the main pocket-forming panel.

6. The article according to claim 1 including separate, narrow sleeves below the fastening means to removably receive portions of the pin means.

7. The article according to claim 6 in which the pin means apply spring pressure to form the dividers for the smaller pockets.

* * * * *